US009120339B2

(12) United States Patent
Hattori

(10) Patent No.: US 9,120,339 B2
(45) Date of Patent: Sep. 1, 2015

(54) IMAGE FORMING APPARATUS AND IMAGE FORMING METHOD

(71) Applicant: TOSHIBA TEC KABUSHIKI KAISHA, Shinagawa-ku, Tokyo (JP)

(72) Inventor: Naoyuki Hattori, Shizuoka-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 42 days.

(21) Appl. No.: 14/153,195

(22) Filed: Jan. 13, 2014

(65) Prior Publication Data

US 2015/0197104 A1 Jul. 16, 2015

(51) Int. Cl.

| | |
|---|---|
| ***B41J 11/50*** | (2006.01) |
| ***B41J 11/04*** | (2006.01) |
| ***B41J 3/407*** | (2006.01) |

(52) U.S. Cl.

CPC ..... *B41J 11/04* (2013.01); *B41J 3/4075* (2013.01); *B41J 11/50* (2013.01)

(58) Field of Classification Search

USPC ..... 347/220

See application file for complete search history.

(56) References Cited

U.S. PATENT DOCUMENTS

| | | | | |
|---|---|---|---|---|
| 4,946,297 | A * | 8/1990 | Koike et al. | 400/82 |
| 6,262,754 | B1 * | 7/2001 | Watanabe et al. | 347/171 |
| 7,530,750 | B2 * | 5/2009 | Ho | 400/649 |

FOREIGN PATENT DOCUMENTS

| | | |
|---|---|---|
| JP | 04-299153 | 10/1992 |
| JP | 2001-199114 | 7/2001 |

* cited by examiner

*Primary Examiner* — Huan Tran

(74) *Attorney, Agent, or Firm* — Amin, Turocy & Watson, LLP

(57) ABSTRACT

According to one embodiment, an image forming apparatus includes an image forming unit, plural rollers, and a roller supporting mechanism. The image forming unit forms an image on a sheet carried in a predetermined carrying direction and extends in an orthogonal direction that is orthogonal to the predetermined carrying direction. The plural rollers are arranged opposite the image forming unit with a carrying path of the sheet arranged in-between and are arranged in a plural number next to each other in the orthogonal direction. The roller supporting mechanism, while pressing the sheet toward the image forming unit, supports the plural rollers in such a way that each roller independently moves, between a carrying position where the sheet is carried in the carrying direction and a separation position where the sheet is separated from the image forming unit.

10 Claims, 14 Drawing Sheets

IMAGE FORMING APPARATUS AND IMAGE FORMING METHOD

FIELD

Embodiments described herein relate generally to a technique of reducing the workload in changing a sheet width in an image forming apparatus capable of forming an image on sheets with plural types of widths.

BACKGROUND

According to a related art, an image forming apparatus such as a label printer in which a continuous paper such as a rolled paper and a ribbon corresponding to the width of the continuous paper are set to print on the continuous paper is known.

With respect to the related-art label printer, a machine type in which plural types of rolled papers with different widths can be used is disclosed.

However, the related-art label printer has a problem that, when the user wants to change the width of the rolled paper used, the rolled paper needs to be replaced with another rolled paper with a different width and the ink ribbon also needs to be replaced with an ink ribbon with a width corresponding to the replacement rolled paper, thus causing a heavy workload.

DETAILED DESCRIPTION

In general, according to one embodiment, an image forming apparatus includes an image forming unit, plural rollers, and a roller supporting mechanism. The image forming unit forms an image on a sheet carried in a predetermined carrying direction and extends in an orthogonal direction that is orthogonal to the predetermined carrying direction. The plural rollers are arranged opposite the image forming unit with a carrying path of the sheet arranged in-between and are arranged in a plural number next to each other in the orthogonal direction. The roller supporting mechanism, while pressing the sheet toward the image forming unit, supports the plural rollers in such a way that each roller independently moves, between a carrying position where the sheet is carried in the carrying direction and a separation position where the sheet is separated from the image forming unit.

First Embodiment

First, a first embodiment will be described.

Hereinafter, the configuration of a label printer 1 (image forming apparatus) according to the embodiment will be described with reference to the drawings.

Figure 1:
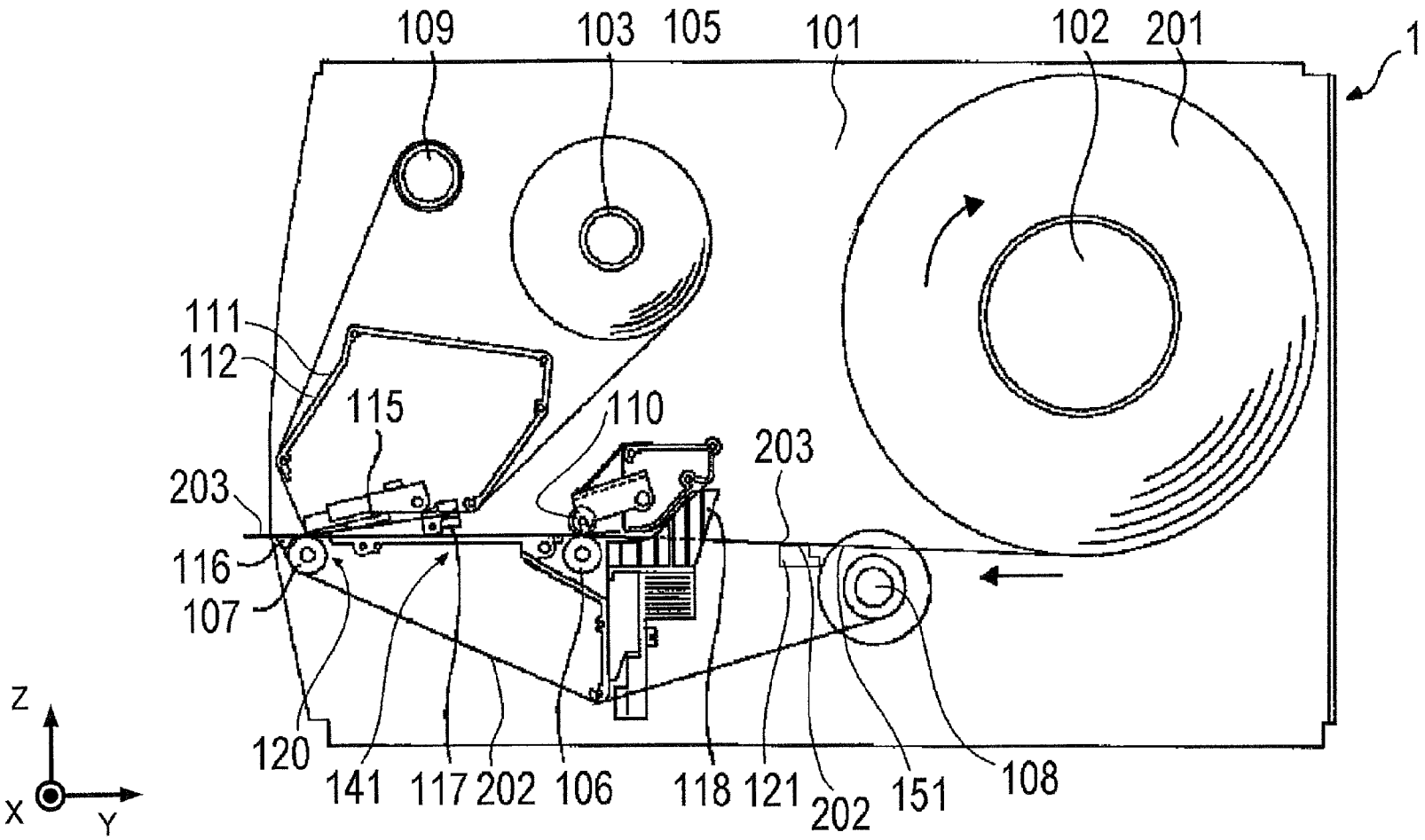
FIG. 1 is a perspective view of a label printer as a first embodiment.

FIG. 1 is a vertical sectional side view of the label printer 1.

In FIG. 1, the X-axis, Y-axis and Z-axis are orthogonal to each other. In the following description, it is assumed that the same relations between the X-axis, Y-axis and Z-axis hold.

Figure 2:
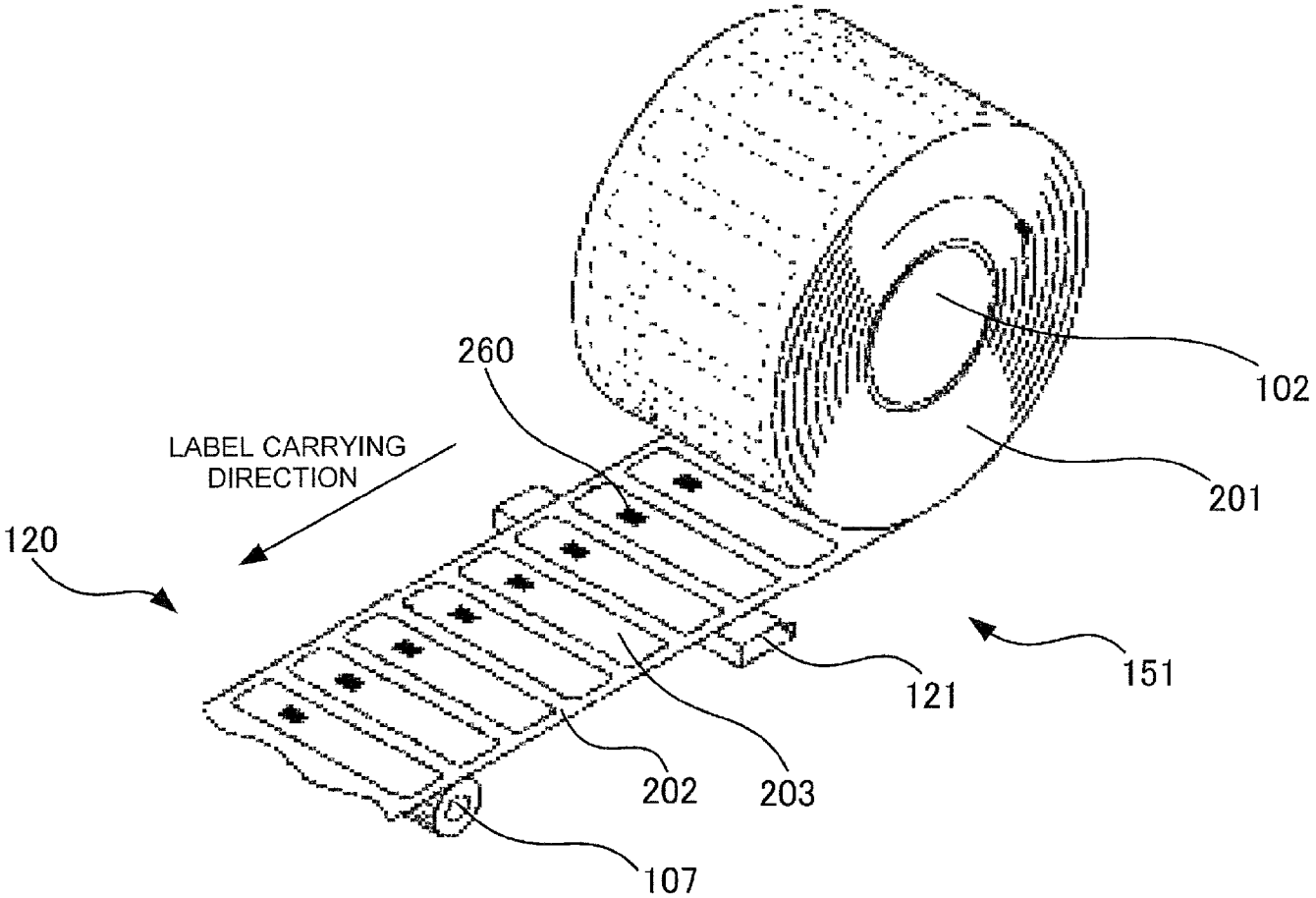
FIG. 2 shows a label sheet installed in the label printer.

The label printer 1 includes a printer main body unit 101. In the printer main body unit 101, an end of a label sheet holding shaft 102 and an end of an ink ribbon holding shaft 103 as holding units are fixed. The label sheet holding shaft 102 rotatably holds a label sheet 201 wound in a roll. The ink ribbon holding shaft 103 holds an ink ribbon 105 wound in a roll. As shown in FIG. 2, the label sheet 201 includes labels 203 pasted at a predetermined interval on a long strip-like backing paper 202. In each label 203, an RFID tag 260 formed by an IC chip and an antenna is embedded.

The label printer 1 includes a carrying mechanism 141, a printing unit 120, and an RFID reader-writer 121. The label printer 1 also includes a reflection sensor 117 forming a print position detection unit, and a reflection sensor 118 forming a write position detection unit. These sensors are used for the carrying mechanism 141 to carry the label sheet 201 and position the label 203.

The carrying mechanism 141 is formed by a carrying roller 106, a pinch roller 110, a platen 107, a thermal head 115, and a motor 55 (see FIG. 3) or the like. The carrying mechanism 141 applies a carrying force to the rolled label sheet 201 held on the label sheet holding shaft 102 and thus causes the label sheet 201 to be reeled out and carried. More specifically, in the printer main body unit 101, the carrying roller 106 connected to and rotationally driven by the motor 55, the platen 107, a rewinder 108, and an end of a ribbon take-up shaft 109 are rotationally held. The pinch roller 110 abuts against an outer peripheral surface of the carrying roller 106 with a predetermined pressure. Moreover, in the printer main body unit 101, a head block 111 formed by a casing 112 opened at a lower end on the side of the platen 107 and the thermal head 115 abutting against an outer peripheral surface of the platen 107 is fixed at a position close to the platen 107.

The label sheet 201 reeled out of the rolled state is passed between the carrying roller 106 and the pinch roller 110 and further passed between the platen 107 and the thermal head 115. That is, in the label printer 1, a carrying path 151 in which the label sheet 201 is carried via such a route is formed. Of the label sheet 201 passed between the platen 107 and the thermal head 115, the backing paper 202 is bent by a label releaser 116 and then reeled up on the rewinder 108, and the label 203 is released from the backing paper 202 and goes straight ahead. Meanwhile, the ink ribbon 105 held in the rolled state on the ink ribbon holding shaft 103 is reeled out of the rolled state and then passed between the platen 107 and the thermal head 115 and reeled up on the ribbon take-up shaft 109.

The printing unit 120 receives a print command from a CPU 51 (see FIG. 3), described later, and prints print data sent from the CPU 51 onto the label 203 on the carrying path 151. The printing unit 120 is formed by the thermal head 115 and the platen 107 or the like.

The reflection sensor 117 is arranged near the thermal head 115. The reflection sensor 117 projects detection light toward the label sheet 201 carried on the carrying path 151, receives, with a light receiving section, reflected light reflected from the backing paper 202 and the label 203, and sends the detection level of the reflected light received by the light receiving section to the CPU 51. The CPU 51 detects whether the label 203 is at a predetermined position or not, based on the detection level of the reflected light inputted from the reflection sensor 117 and a carrying distance by which the label is carried through the carrying path 151 by drive-controlling the carrying mechanism 141. That is, the reflection sensor 117 and the CPU 51 play the role of a print position detection unit which detects whether the label 203 is positioned at a predetermined position or not.

The RFID reader-writer 121 is situated on a lower surface side that is between the carrying roller 106 and the rewinder 108 and that is one surface side of the carrying path 151, and thus fixed in the printer main body unit 101. The RFID reader-writer 121 includes a reader-writer antenna therein and executes wireless communication with the RFID tag included in the label 203 and writes RFID data sent from the CPU 51.

The reflection sensor 118 is arranged near the RFID reader-writer 121. The reflection sensor 118 projects detection light toward an upper surface of the label sheet 201 carried on the carrying path 151, receives, with a light receiving section, reflected light reflected from the backing paper 202 and the label 203, and sends the detection level of the reflected light received by the light receiving section to the CPU 51. The CPU 51 detects whether the label 203 is positioned at a write position, based on a change in the detection level of the reflected light inputted from the reflection sensor 118 and the carrying distance by which the label is carried through the carrying path 151 by drive-controlling the carrying mechanism 141. That is, the reflection sensor 118 and the CPU 51 play the role of a write position detection unit which detects whether the label 203 is positioned at a write position or not.

Figure 3:
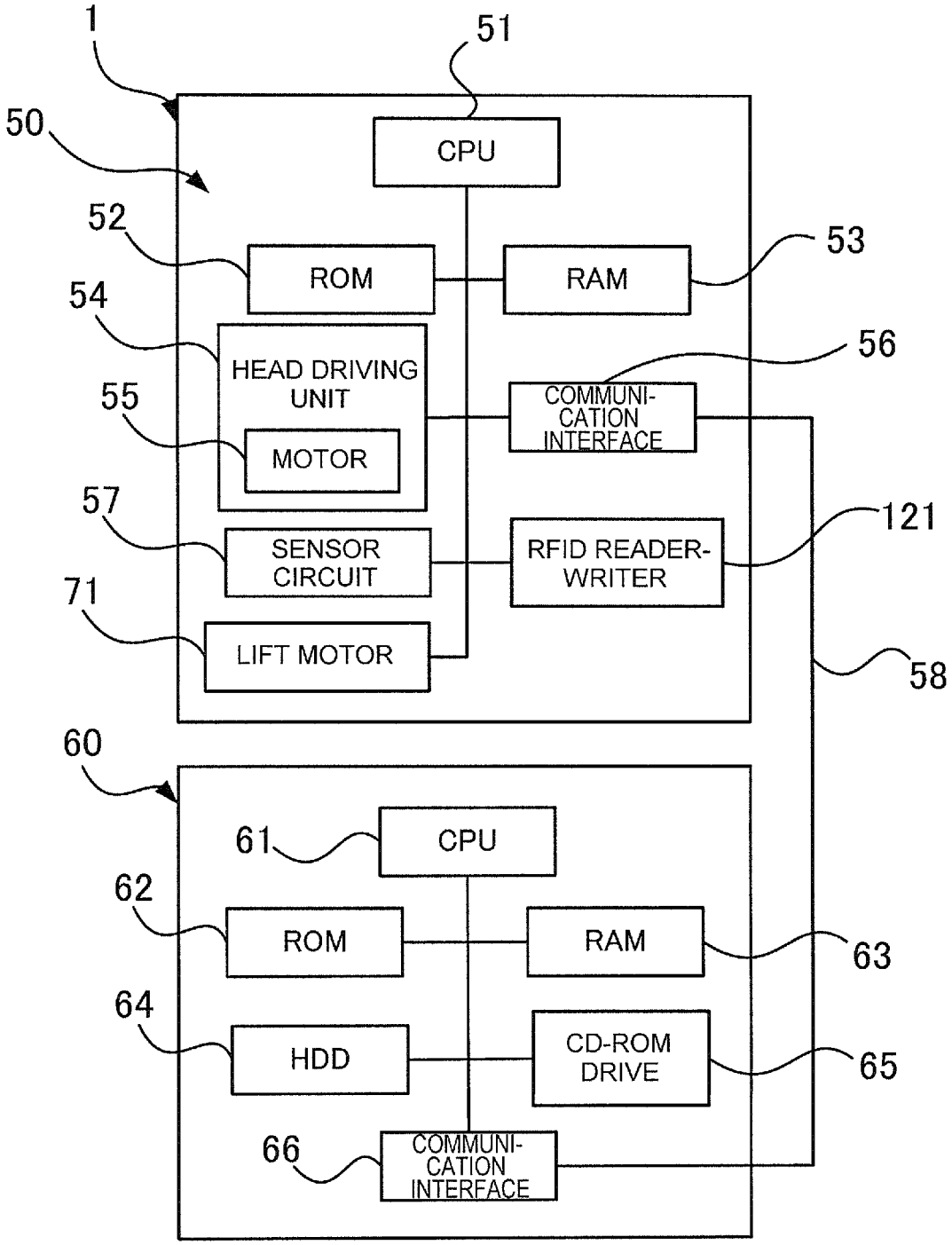
FIG. 3 is a block diagram showing the hardware configuration of the label printer.

FIG. 3 is a block diagram showing the hardware configuration of the label printer 1. The label printer 1 includes the CPU 51 which executes various kinds of arithmetic processing and controls each unit. A ROM 52 which stores and saves fixed data in a fixed manner, and a RAM 53 which stores variable data in a rewritable manner and is used as a work area, are connected to the CPU 51 via a bus. The CPU 51, the ROM 52 and the RAM 53 form a microcomputer 50 as a control unit which execute information processing and drive-controls each unit. As an example, the microcomputer 50 executes various kinds of processing in accordance with a program code that is a computer program recorded as firmware in the ROM 52, while using the RAM 53 as a work area. The RAM 53 is not only used as a work area but also plays the role of a storage unit which stores various kinds of information sent, for example, from a computer 60, later described.

A head driving unit 54 for drive-controlling the thermal head 115 and the motor 55, a sensor circuit 57 including the reflection sensor 117 and the reflection sensor 118, the RFID reader-writer 121, a communication interface 56, and a lift motor 71 are all connected to the CPU 51 via various input-output circuits (none of them shown) and are controlled in operations thereof by the microcomputer 50.

The head driving unit 54 is a digital circuit for drive-controlling the thermal head 115 and the motor 55, based on print data. As an example, such a head driving unit 54 is an aggregate of elements formed by semiconductor technology. The motor 55 is a driving source which rotationally drives the carrying roller 106, the platen 107, the rewinder 108, the ribbon take-up shaft 109 and the like. As an example, this motor 55 is a stepping motor which rotates in both forward and backward directions.

The lift motor 71, though not shown in FIG. 1, moves a rack gear 73 (shown in FIG. 4) up and down in the Z direction. Thus, the rack gear 73 moves the platen 107 up and down. The mechanism of moving the platen 107 up and down will be described in detail later.

The sensor circuit 57 supplies electric power to the reflection sensor 117 and the reflection sensor 118, converts sensing signals sent from the reflection sensor 117 and the reflection sensor 118 into digital signals, and sends the digital signals to the microcomputer 50.

The communication interface 56 realizes data communication with the computer 60 as an external device via a communication cable 58.

The computer 60 includes a CPU (central processing unit) 61, a ROM (read only memory) 62, a RAM (random access memory) 63 as a storage unit, an HDD 64, a CD-ROM drive 65, a communication interface 66 and the like. The computer 60 is connected to the label printer 1 in such a way that data communication can be carried out. In the HDD 64 of the computer 60, a program which realizes various functions is stored. The CPU 61 executes various kinds of information processing based on the description of this stored program.

Figure 4:
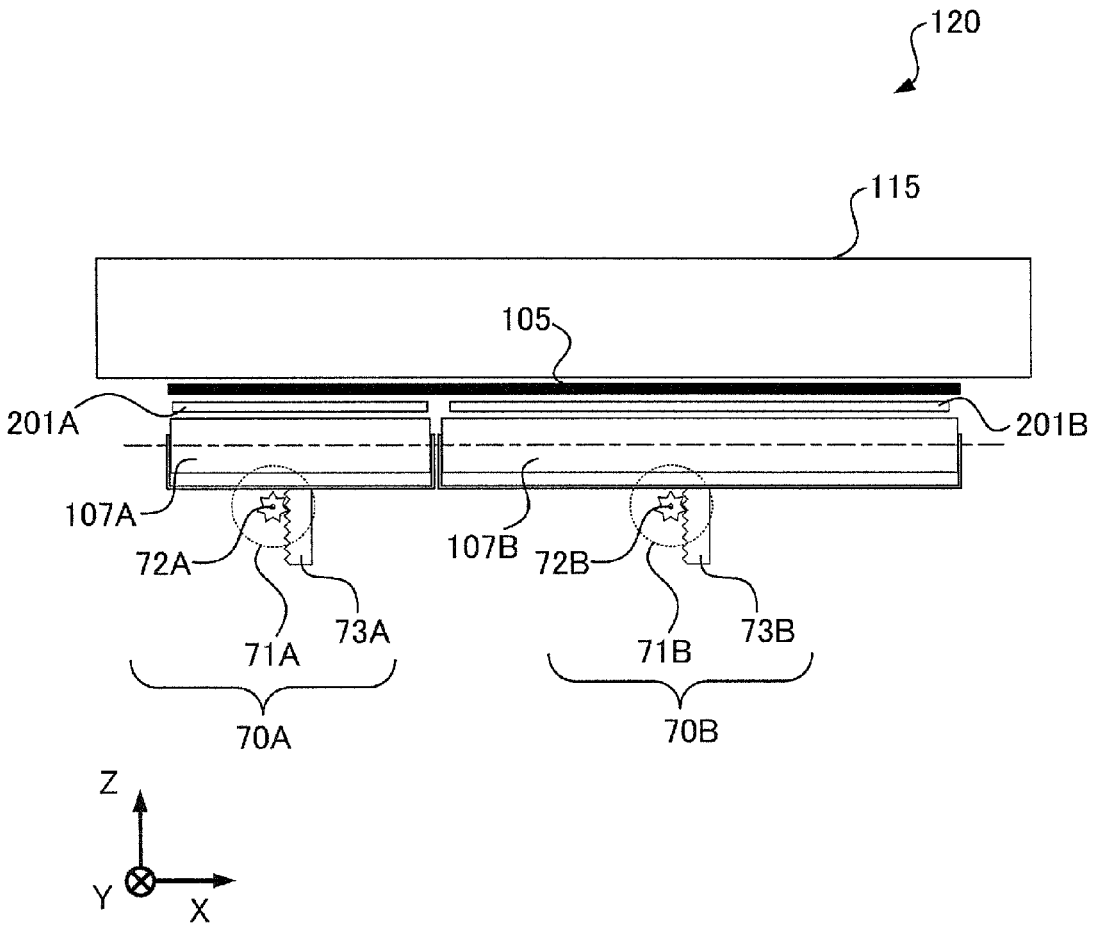
FIG. 4 shows a printing unit in the label printer.

FIG. 4 shows the printing unit 120 of the label printer 1 shown in FIG. 1, as viewed in the Y direction of FIG. 1.

The printing unit 120 includes the thermal head 115 (image forming unit), the platen (roller) 107, and a roller supporting mechanism 70. The platen 107 includes platen 107A and a platen 107B. The roller supporting mechanism 70 includes a roller supporting mechanisms 70A and 70B. The roller supporting mechanism 70A (70B) includes a lift motor 71A (71B), a pinion gear 72A (72B), and a rack gear 73A (73B).

The thermal head 115 extends in an orthogonal direction (X direction) orthogonal to the carrying path 151 (shown in FIG. 1) and forms an image on a label sheet 201A (201B) carried on the carrying path 151.

The platen (roller) 107A (107B) is arranged opposite the thermal head 115, with the carrying path 151 of the label sheet 201A (201B) arranged in-between, and is arranged in a plural number next to each other in the orthogonal direction (X-axis direction) orthogonal to the carrying path 151. In this embodiment, as the platens 107A (107B), two platens 107A and 107B are arranged next to each other.

Here, of the plural platens 107, at least one platen 107 (for example, the platen 107A) can be different from another platen 107 (for example, the platen 107B) in the width in the orthogonal direction (direction of rotation axis of the platen 107) orthogonal to the carrying path 151.

Also, the total of the length of each of the plural platens 107 in the direction of rotation axis corresponds to the width of the label sheet 201 having the maximum width available in the label printer 1. The "width" used here means the size of the label sheet 201 in a direction orthogonal to the reel-out direction thereof.

The roller supporting mechanism 70 presses the label sheet 201 toward the thermal head 115. The roller supporting mechanism 70 also supports the plural platens 107 between a carrying position where the label sheet 201 can be carried in the carrying direction and a separation position where the label sheet 201 is separated from the thermal head 115, in such a way that each of the plural platens 107 can move independently.

The roller supporting mechanism 70A (70B) will be described specifically. The roller supporting mechanism 70A (70B) includes the lift motor 71A (71B), the pinion gear 72A (72B), and the rack gear 73A (73B). The lift motor 71A (71B) drives and thus rotates the pinion gear 72A (72B). The pinion gear 72A (72B) is rotated by the driving force of the lift motor 71A (71B) and moves the rack gear 73A (73B) in up and down directions (Z-axis direction). As the pinion gear 72A (72B) rotates counterclockwise, the rack gear 73A (73B) moves upward (Z direction) and moves the platen 107A (107B) upward (Z direction).

As the platen 107A (107B) moves upward, the label sheet 201A (201B) and the ink ribbon 105 are pressed against the thermal head 115 and an image is formed on the label sheet 201A (201B).

Figure 5:
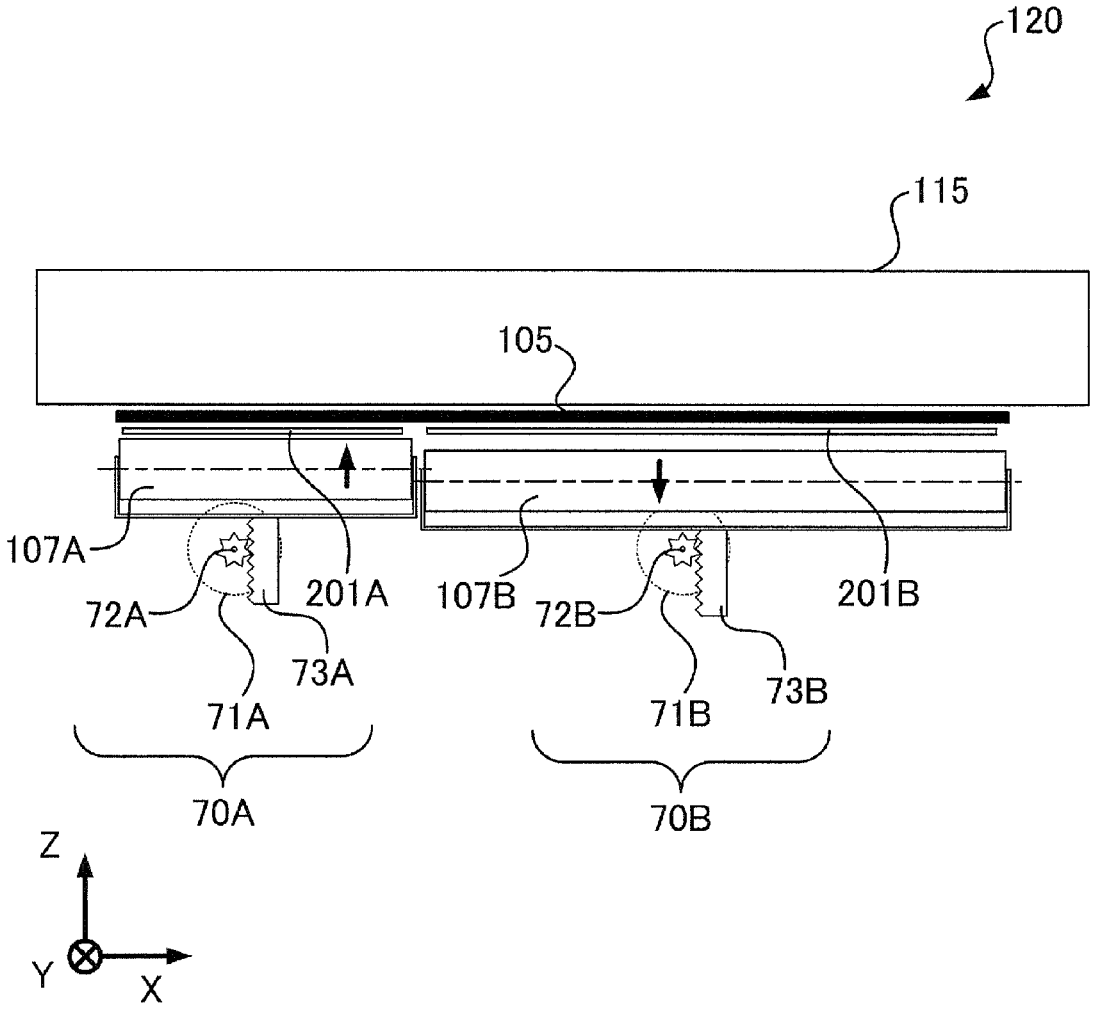
FIG. 5 shows the printing unit.

FIG. 5 shows the platen 107A pushed up by the rack gear 73A. As the platen 107A presses the label sheet 201A against the thermal head 115, an image is formed on the label sheet 201A.

Figure 6:
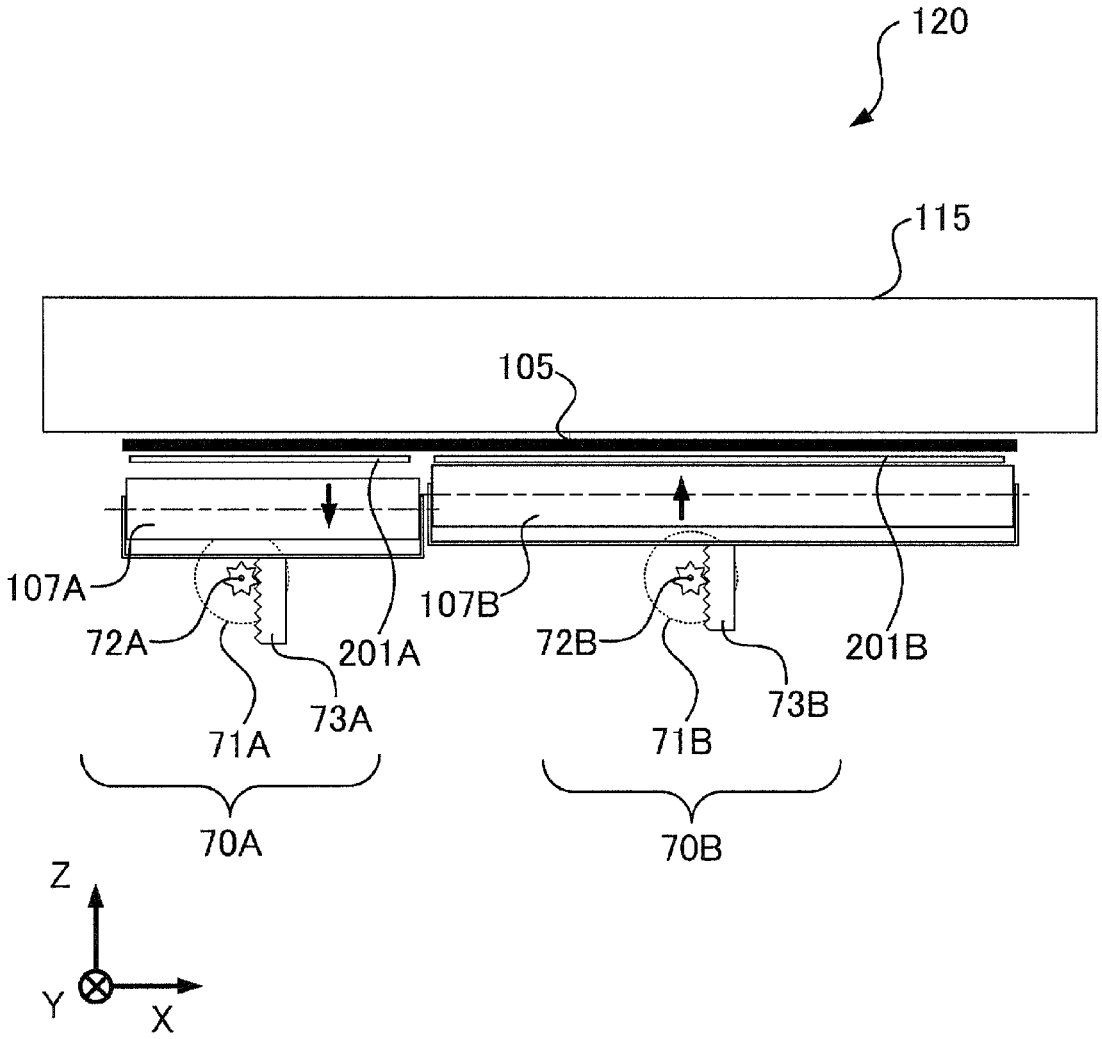
FIG. 6 shows the printing unit.

FIG. 6 shows the state of the printing unit 120 where the platen 1073 is pushed up by the roller supporting mechanism 70B. As the platen 107B presses the label sheet 201B against the thermal head 115, an image is formed on the label sheet 201B.

According to the related art, the label printer has a problem that, when the user wants to change the width of the label sheet used, the label sheet needs to be replaced with a label sheet with a different width and the ink ribbon also needs to be replaced with an ink ribbon with a width corresponding to the replacement label sheet, thus causing a heavy workload.

However, in the label printer 1, since the platen (roller) is divided and thus arranged, an image can be formed on the label sheet 201A (201B) without replacing the label sheet 201A (201B) if the label sheet 201A (201B) has a shorter width than the length in the direction of rotation axis of the divided platen 107A (107B). In the label printer 1, the ink ribbon 105 that has a length corresponding to the length in the axial direction of the platens 107A and 107B is used, the workload of replacing the ink ribbon 105 can be reduced.

Figure 7:
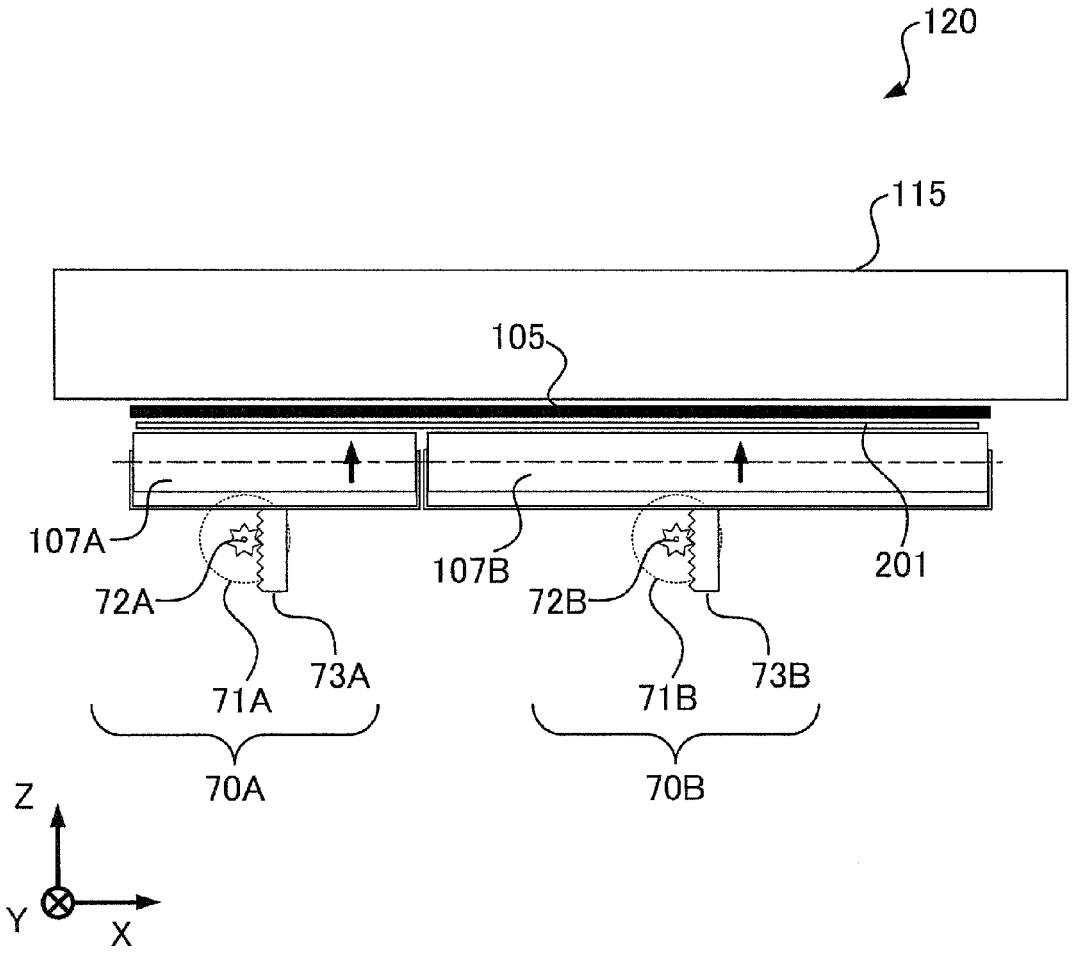
FIG. 7 shows the printing unit.

FIG. 7 shows the state where an image is formed on the label sheet 201 having a length corresponding to the length in the direction of rotation axis of the platens 107A and 107B. As the platens 107A and 107B are pushed up simultaneously, an image can be formed on the label sheet 201 having a length corresponding to the length in the direction of rotation axis of the platens 107A and 107B. Thus, an image can be formed on a label sheet having a maximum width equal to the length corresponding to the length in the axial direction of the platens 107A and 107B.

Figure 8:
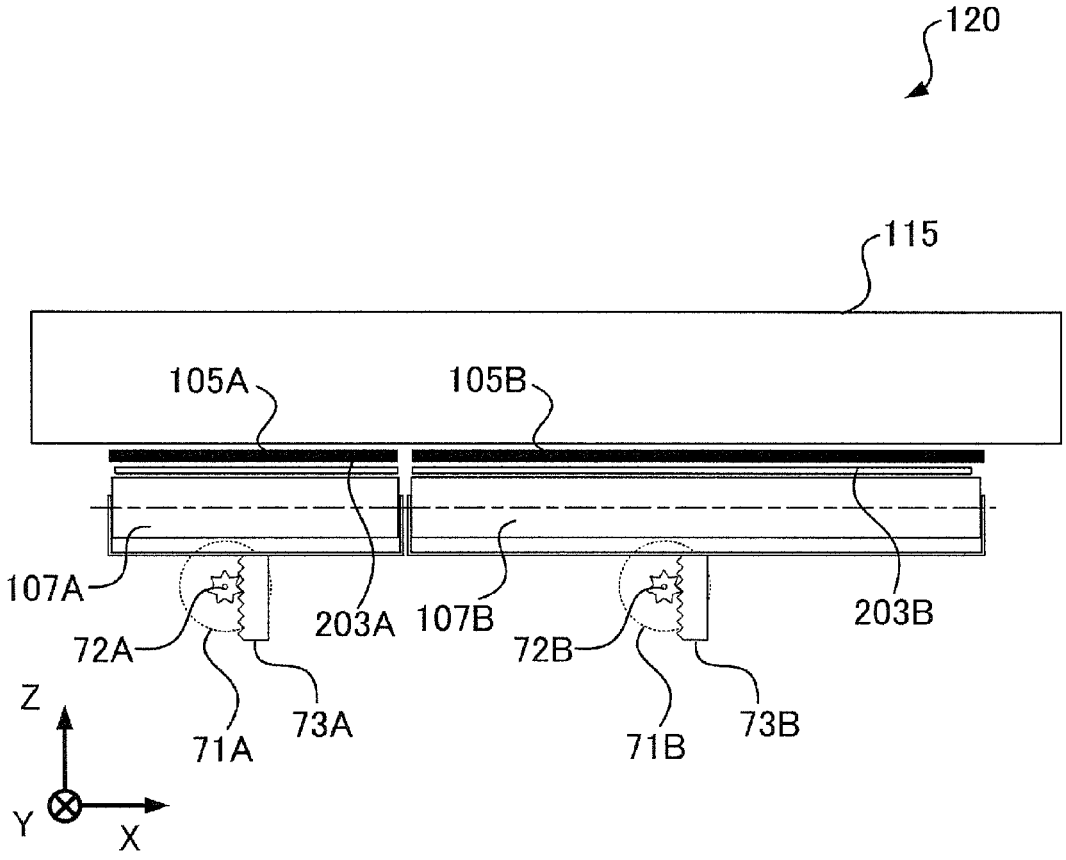
FIG. 8 shows the printing unit.

FIG. 8 shows the division of the ink ribbon 105 into an ink ribbon 105A and an ink ribbon 105B in the printing unit 120 shown in FIG. 7.

In FIG. 5, for example, if an image is formed only on the label sheet 201A, the ink ribbon on the side of the label sheet 201B is not used. By dividing the ink ribbon 105 into the ink ribbons 105A and 1058, the consumption of the ink ribbon 105 can be reduced. In this case, the use in which the platens 107A and 107B are lifted up simultaneously as shown in FIG. 7 cannot be realized.

Figure 9:
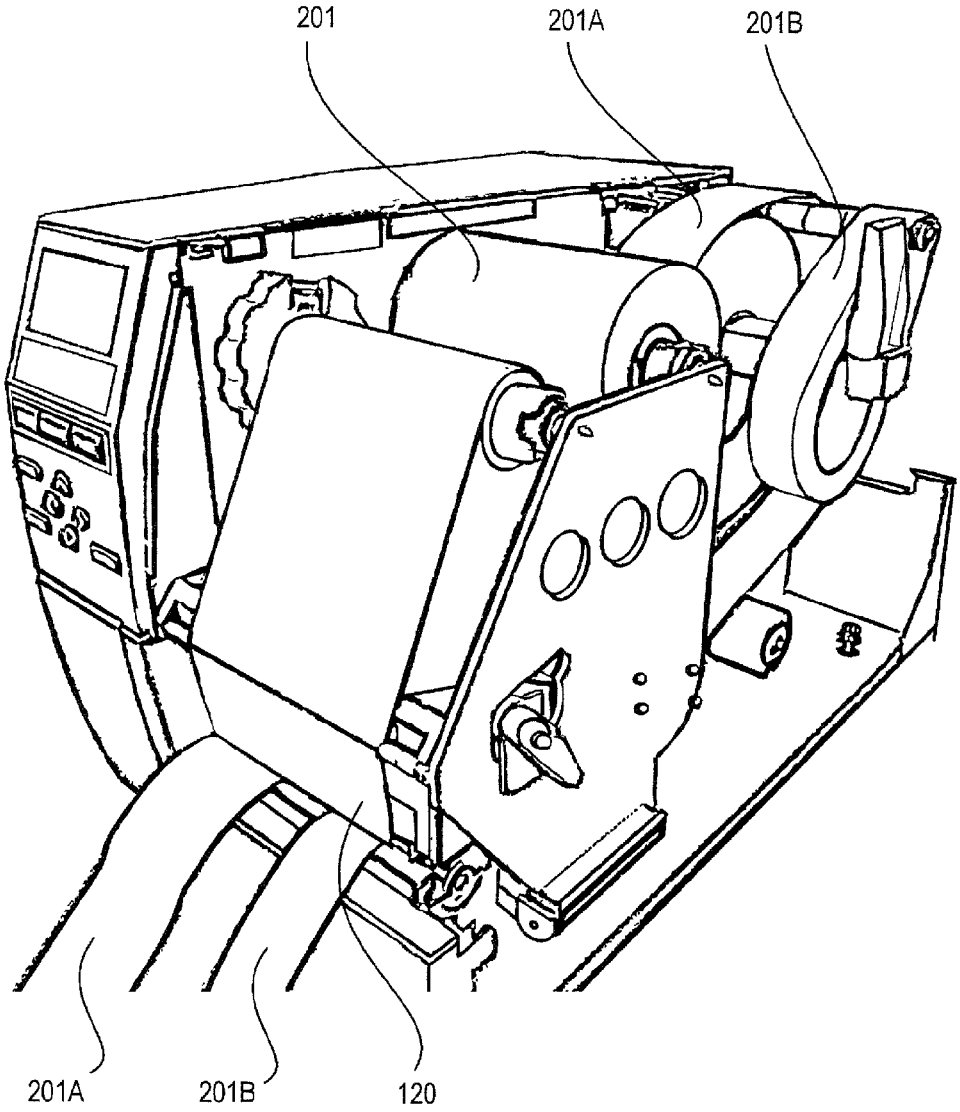
FIG. 9 is a perspective view of the label printer.

FIG. 9 is a perspective view of the label printer 1 of the embodiment. As shown in FIG. 9, the label sheets 201 with different widths can be used without replacing the label sheets 201.

In this embodiment, as an example, the number of divisions of the roller that presses the label sheet 201 against the thermal head 115 is two. However, the number of divisions is not limited to this example and the roller may be divided into three or more.

The widths of the plural thermal heads arrayed in the label printer in this embodiment need not differ from each other and may be the same. Also, label sheets with various widths can be used on a platen with a certain width.

Also, while the label printer 1 employs the label sheet 201 as an image forming medium, for example, a rolled paper, fanfold paper and the like can be used other than the label sheet 201.

While the label printer 1 of this embodiment employs a thermal head as an image forming unit, the image forming unit is not limited to this example.

Each operation in the processing in the image forming apparatus is realized as the CPU 51 executes the program stored in the ROM 52.

Second Embodiment

Next, a second embodiment will be described.

The second embodiment is a modification of the first embodiment. Hereinafter, the parts having similar functions to the parts already described in the first embodiment are denoted by the same reference numerals and will not be described further in detail.

Figure 10:
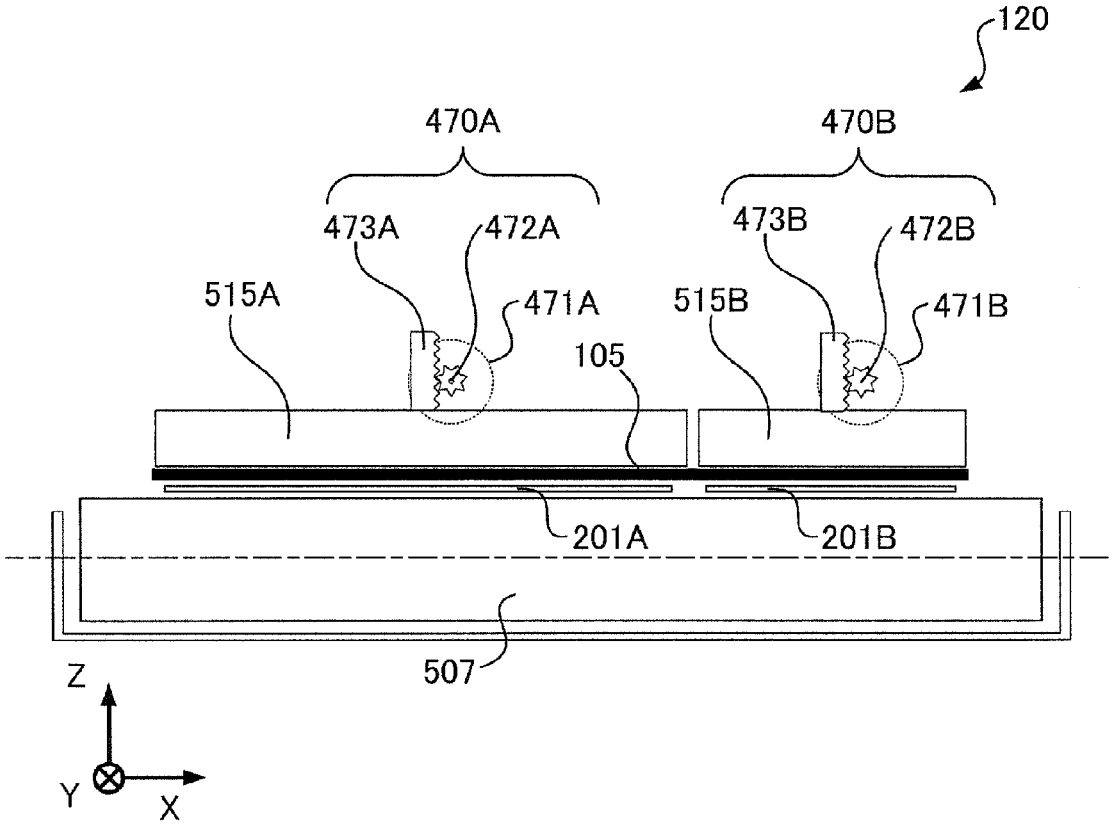
FIG. 10 shows a printing unit of a label printer as a second embodiment.

FIG. 10 shows the printing unit 120 of the label printer 1 shown in FIG. 1, as viewed in the Y direction of FIG. 1.

The printing unit 120 includes a thermal head (image forming unit) 515 (thermal heads 515A and 515B), a platen (roller) 517, and a thermal head supporting mechanism 470. The thermal head supporting mechanism 470 includes thermal head supporting mechanisms 470A and 470B. The thermal head supporting mechanism 470A (470B) is formed by a lift motor 471A (471B), a pinion gear 472A (472B), and a rack gear 473A (473B).

The thermal head 515A (515B) extends in an orthogonal direction (X direction) orthogonal to the carrying path 151 (shown in FIG. 1) and forms an image on a label sheet 201A (201B) carried on the carrying path 151.

In the second embodiment, the thermal head 515 is divided into the thermal heads 515A and 515B and the thermal head supporting mechanism 470A (470B) pushes the thermal head 515A (515B) down.

The thermal head 515A (515B) is arranged opposite the platen 507 with the carrying path 151 of the label sheet 201A (201B) arranged in-between, and is arranged in a plural number next to each other in the orthogonal direction (X-axis direction) orthogonal to the carrying path 151.

Here, of the plural thermal heads 515, at least one thermal head 515 (for example, the thermal head 515A) can be different from another thermal head 515 (for example, the thermal head 515B) in the width in the orthogonal direction (X-axis direction) orthogonal to the carrying path 151.

Also, the total of the length of each of the plural thermal heads 515 in the X-axis direction corresponds to the width of the label sheet 201 having the maximum width available in the label printer 1. The "width" used here means the size of the label sheet 201 in a direction orthogonal to the reel-out direction thereof.

The thermal head supporting mechanism 470A (470B) pushes the thermal head 515A (515B) down and thus presses the label sheet 201A (201B) toward the platen 507. The thermal head supporting mechanism 470A (470B) also supports the plural thermal heads 515 between a carrying position where the label sheet 201A (201B) can be carried in the carrying direction and a separation position where the label sheet 201A (201B) is separated from the thermal head 515, in such a way that each of the plural thermal heads 515 can move independently.

The thermal head supporting mechanism 470A (470B) will be described specifically. The thermal head supporting mechanism 470A (470B) includes the lift motor 471A (471B), the pinion gear 472A (472B), and the rack gear 473A (473B). The lift motor 471A (471B) drives and thus rotates the pinion gear 472A (472B). The pinion gear 472A (472B) is rotated by the driving force of the lift motor 471A (471B) and moves the rack gear 473A (473B) in up and down directions (Z-axis direction). As the pinion gear 472A (472B) rotates counterclockwise, the rack gear 473A (473B) moves downward (Z-axis negative direction) and moves the thermal head 515A (515B) downward (Z-axis negative direction).

As the thermal head 515A (515B) moves downward, the label sheet 201A (201B) and the ink ribbon 105 are pressed against the platen 507 and an image is formed on the label sheet 201A (201B).

Figure 11:
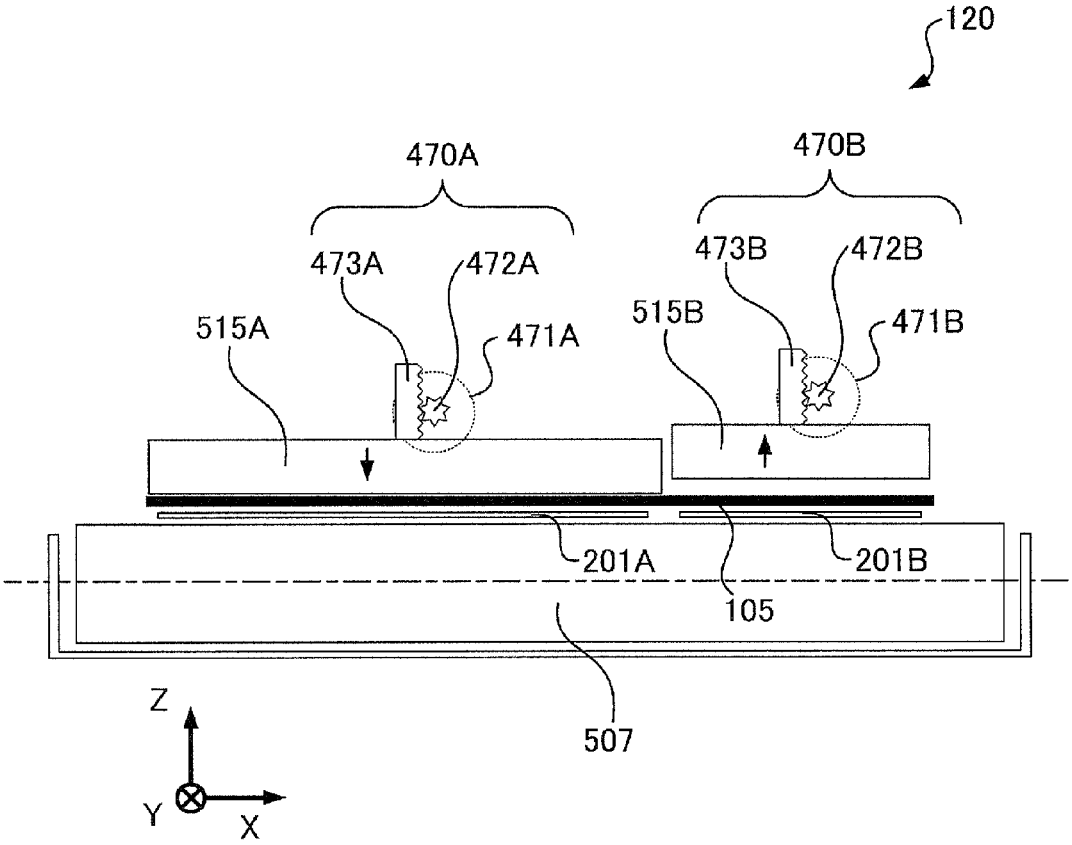
FIG. 11 shows the printing unit.

FIG. 11 shows the thermal head 515A pushed down by the rack gear 473A. As the thermal head 515A presses the label sheet 201A against the platen 507, an image is formed on the label sheet 201A.

Figure 12:
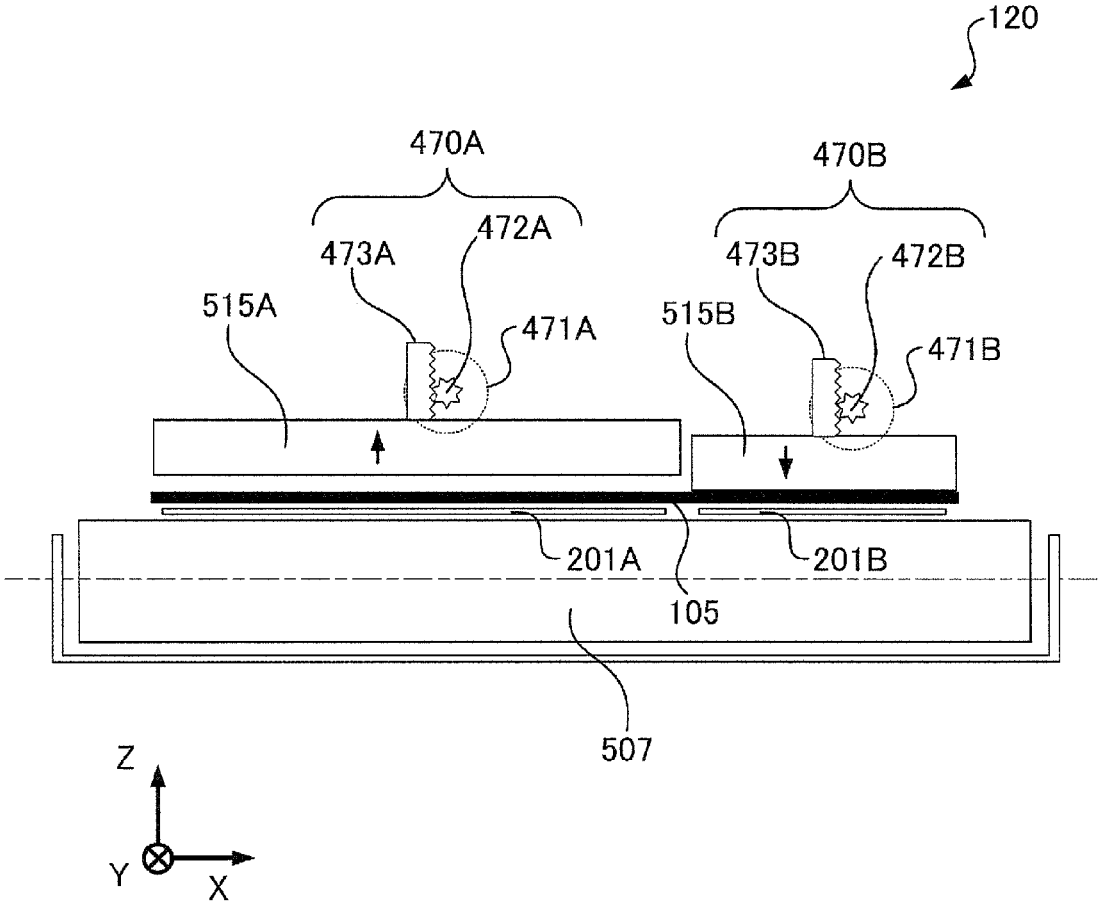
FIG. 12 shows the printing unit.

FIG. 12 shows the state of the printing unit 120 where the thermal head 515B is pushed down by the thermal head supporting mechanism 470B. As the thermal head 515B presses the label sheet 201B against the platen 507, an image is formed on the label sheet 201B.

According to the related art, the label printer has a problem that, when the user wants to change the width of the label sheet used, the label sheet needs to be replaced with a label sheet with a different width and the ink ribbon also needs to be replaced with an ink ribbon with a width corresponding to the replacement label sheet, thus causing a heavy workload.

However, in the label printer 1, since the thermal head (image forming unit) is divided and thus arranged, an image can be formed on the label sheet 201 without replacing the label sheet 201A (201B) if the label sheet 201A (201B) has a shorter width than the length in the X-axis direction of the divided thermal head 515A (515B). In the label printer 1, the ink ribbon 105 that has a length corresponding to the length in the axial direction of the thermal heads 515A and 515B is used, the workload of replacing the ink ribbon 105 can be reduced.

Figure 13:
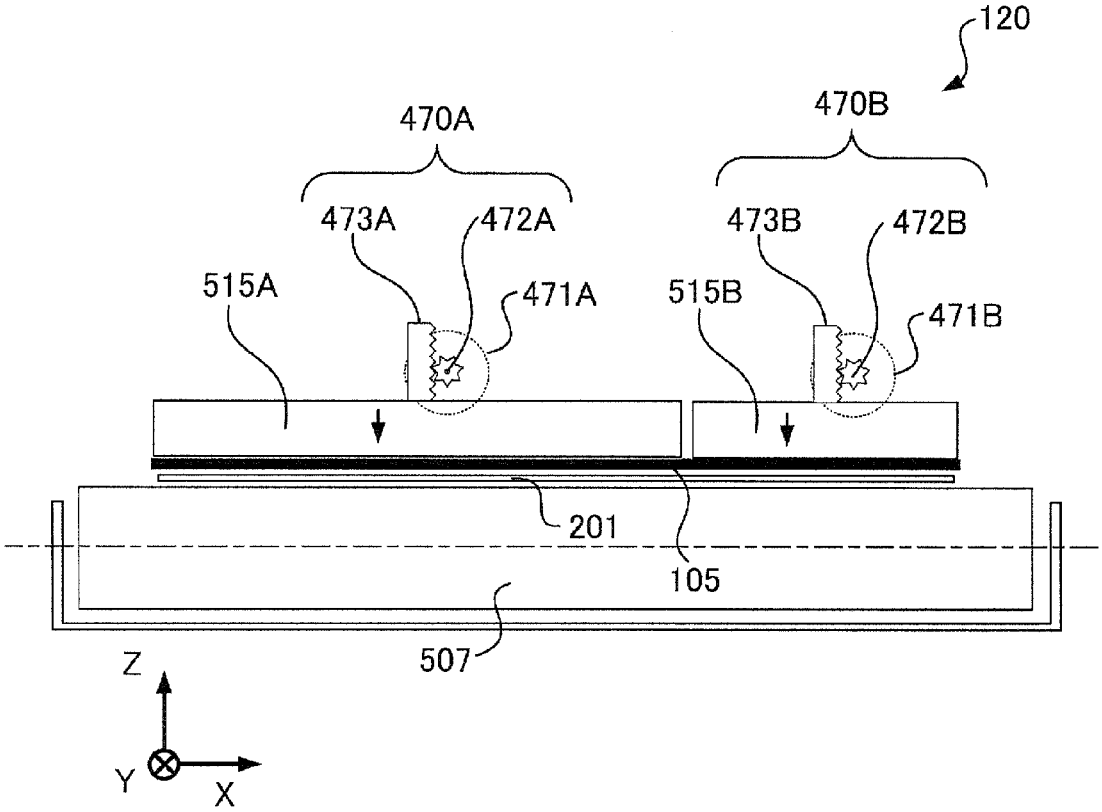
FIG. 13 shows the printing unit.

FIG. 13 shows the state where an image is formed on the label sheet 201 having a length corresponding to the length in the direction of rotation axis of the thermal heads 515A and 515B. As the thermal heads 515A and 515B are pushed down simultaneously, an image can be formed on the label sheet 201 having a length corresponding to the length in the direction of rotation axis of the thermal heads 515A and 515B. Thus, an image can be formed on a label sheet having a maximum width equal to the length corresponding to the length in the axial direction of the thermal heads 515A and 515B.

Figure 14:
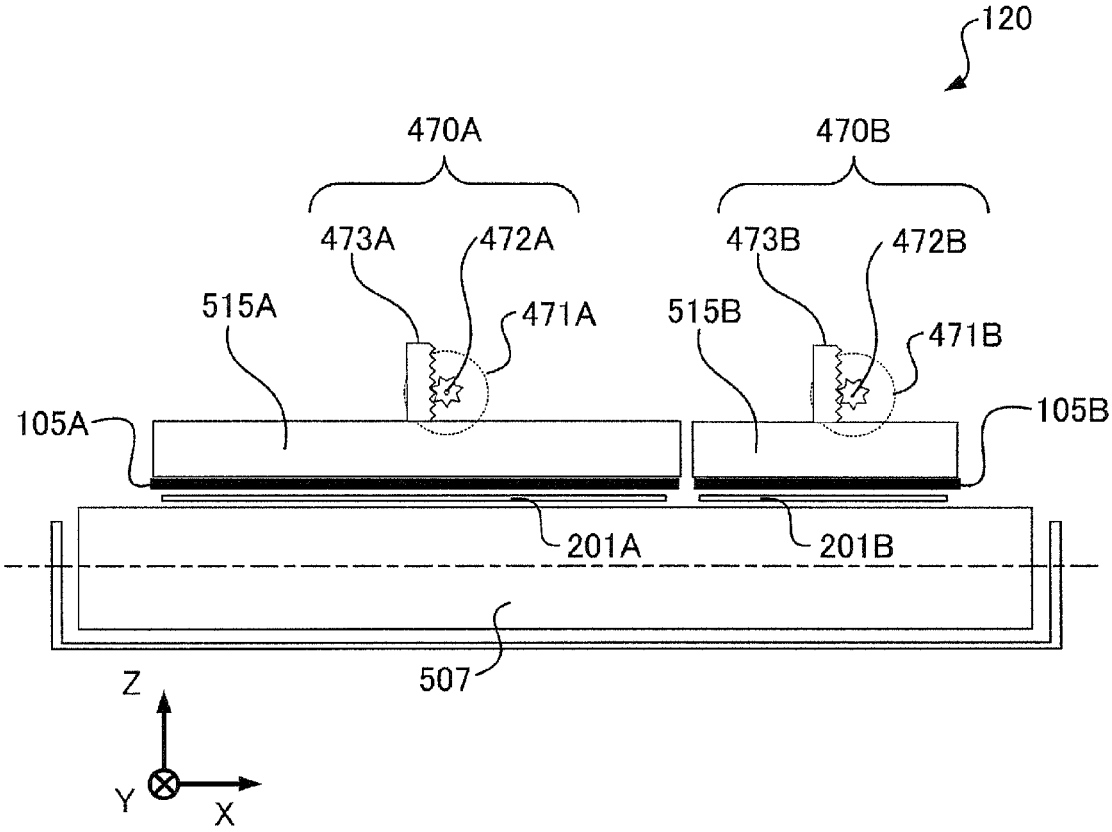
FIG. 14 shows the printing unit.

FIG. 14 shows the division of the ink ribbon 105 into an ink ribbon 105A and an ink ribbon 105B in the printing unit 120 shown in FIG. 13.

In FIG. 10, for example, if an image is formed only on the label sheet 201A, the ink ribbon on the side of the label sheet 201B is reeled up on the ribbon take-up shaft 109 (FIG. 1) without being used. That is, by dividing the ink ribbon 105 into the ink ribbons 105A and 105B, the consumption of the ink ribbon 105 can be reduced. However, in this case, the use in which the thermal heads 515A and 515B are pushed down simultaneously as shown in FIG. 13 cannot be realized.

In this embodiment, as an example, the number of divisions of the thermal head 515 that presses the label sheet 201 against the platen 507 is two. However, the number of divisions is not limited to this example and the thermal head may be divided into three or more.

The widths of the plural thermal heads arrayed in the label printer in this embodiment need not differ from each other and may be the same. Also, label sheets with various widths can be used on a platen with a certain width.

Also, while the label printer 1 employs the label sheet 201 as an image forming medium, for example, a rolled paper, fanfold paper and the like can be used other than the label sheet 201.

While the label printer 1 of this embodiment employs a thermal head as an image forming unit, the image forming unit is not limited to this example.

Each operation in the processing in the image forming apparatus is realized as the CPU 51 executes the program stored in the ROM 52.

As described above, according to the second embodiment, for example, an image forming apparatus having the following characteristics (1) to (5) can be provided.

(1) An image forming apparatus includes: plural image forming units which form an image on a sheet carried in a predetermined carrying direction and which extend in an orthogonal direction that is orthogonal to the predetermined carrying direction and are arranged in a plural number next to each other in the orthogonal direction; a roller arranged opposite the plural image forming units with a carrying path of the sheet arranged in-between; and a supporting mechanism which, while pressing the sheet toward the roller, supports the plural image forming units in such a way that each image forming unit independently moves, between a carrying position where the sheet is carried in the carrying direction and a separation position where the sheet is separated from the roller.

With such a configuration, for example, when the user uses only continuous sheets with the same width, it suffices to replace only a head portion that is deteriorated as a result of the use, thus contributing to a reduction in the replacement cost of the image forming unit such as a thermal head.

(2) In the apparatus of (1), at least one of the plural image forming units is different from another image forming unit in the width in the orthogonal direction.

(3) In the apparatus of (1), the total of the length of each of the plural image forming units in the direction of rotation axis corresponds to the width of a sheet with the maximum width available in the apparatus.

(4) In the apparatus of (1), the sheet is a continuous paper.

(5) In the apparatus of (1), the image forming unit is a thermal head.

Of course, instead of dividing only one of the image forming unit and the roller that presses the sheet toward the image forming unit, both the roller and the head may be divided and each roller and head may abut against and separate from each other independently.

As described above in detail, according to the technique disclosed here, a technique that reduced the workload in changing the width of the sheet in an image forming apparatus capable of forming an image on sheets with plural kinds of widths can be provided.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the sprit of the inventions. The accompanying claims and their equivalents are intended to cover such forms or modifications as would fall within the scope and spirit of the inventions.

What is claimed is:

1. An image forming apparatus comprising:

an image forming unit which forms an image on a sheet carried in a predetermined carrying direction and extends in an orthogonal direction that is orthogonal to the predetermined carrying direction;

plural rollers which are arranged opposite the image forming unit with a carrying path of the sheet arranged in-between and are arranged in a plural number next to each other in the orthogonal direction; and a roller supporting mechanism which, while pressing the sheet toward the image forming unit, supports the plural rollers in such a way that each roller independently moves, between a carrying position where the sheet is carried in the carrying direction and a separation position where the sheet is separated from the image forming unit.

2. The apparatus according to claim 1, wherein at least one of the plural rollers is different from another roller in a width in the orthogonal direction.

3. The apparatus according to claim 1, wherein a total of length of each of the plural rollers in a direction of rotation axis corresponds to a width of a sheet with a maximum width available in the apparatus.

4. The apparatus according to claim 1, wherein the sheet is a continuous paper.

5. The apparatus according to claim 1, wherein the image forming unit is a thermal head.

6. An image forming method in an image forming apparatus comprising: an image forming unit which forms an image on a sheet carried in a predetermined carrying direction and extends in an orthogonal direction that is orthogonal to the predetermined carrying direction; plural rollers which are arranged opposite the image forming unit with a carrying path of the sheet arranged in-between and are arranged in a plural number next to each other in the orthogonal direction; and a roller supporting mechanism which, while pressing the sheet toward the image forming unit, supports the plural rollers in such a way that each roller independently moves, between a carrying position where the sheet is carried in the carrying direction and a separation position where the sheet is separated from the image forming unit, the method comprising:

controlling the plural rollers in such a way that each roller independently moves, between a carrying position where the sheet is carried in the carrying direction and a separation position where the sheet is separated from the image forming unit, while pressing the sheet toward the image forming unit.

7. The method according to claim 6, wherein at least one of the plural rollers is different from another roller in a width in the orthogonal direction.

8. The method according to claim 6, wherein a total of length of each of the plural rollers in a direction of rotation axis corresponds to a width of a sheet with a maximum width available in the apparatus.

9. The method according to claim 6, wherein the sheet is a continuous paper.

10. The method according to claim 6, wherein the image forming unit is a thermal head.

* * * * *